US010883324B2

(12) United States Patent
Taylor, III et al.

(10) Patent No.: US 10,883,324 B2
(45) Date of Patent: Jan. 5, 2021

(54) DRILLING FLUID SYSTEM

(71) Applicant: The Charles Machine Works, Inc., Perry, OK (US)

(72) Inventors: Virgil H. Taylor, III, Stillwater, OK (US); Carlo Salas, Gilbert, AZ (US); Jacob Harman, Stillwater, OK (US); Brant D. Kukuk, Perry, OK (US); Brian McRae, Bristow, OK (US)

(73) Assignee: The Charles Machine Works, Inc., Perry, OK (US)

( * ) Notice: Subject to any disclaimer, the term of this patent is extended or adjusted under 35 U.S.C. 154(b) by 137 days.

(21) Appl. No.: 16/149,590

(22) Filed: Oct. 2, 2018

(65) Prior Publication Data

US 2019/0100972 A1 Apr. 4, 2019

Related U.S. Application Data

(60) Provisional application No. 62/566,737, filed on Oct. 2, 2017.

(51) Int. Cl.

| | |
|---|---|
| ***E21B 21/01*** | (2006.01) |
| ***E21B 21/08*** | (2006.01) |
| ***E21B 7/04*** | (2006.01) |
| ***E21B 7/02*** | (2006.01) |

(52) U.S. Cl.

CPC ..... *E21B 21/01* (2013.01); *E21B 7/02* (2013.01); *E21B 7/046* (2013.01); *E21B 21/08* (2013.01)

(58) Field of Classification Search

CPC . E21B 21/01; E21B 21/08; E21B 7/02; E21B 7/046

USPC ..... 173/189, 35, 184, 190, 156

See application file for complete search history.

(56) References Cited

U.S. PATENT DOCUMENTS

| | | | | |
|---|---|---|---|---|
| 6,497,296 | B1 * | 12/2002 | McGriff | E21B 7/046 175/162 |
| 2003/0205409 | A1 * | 11/2003 | Koch | C12N 9/93 175/26 |
| 2008/0169128 | A1 * | 7/2008 | Olander | E21B 21/01 175/25 |
| 2009/0008110 | A1 * | 1/2009 | Osadchuk | E21B 7/02 173/1 |
| 2009/0014215 | A1 * | 1/2009 | Hartke | E21B 7/046 175/52 |
| 2009/0236146 | A1 * | 9/2009 | Pierz | E21B 7/046 175/62 |
| 2012/0083944 | A1 * | 4/2012 | Heieie | E21B 7/046 701/2 |
| 2014/0284111 | A1 * | 9/2014 | Van Zee | E21B 7/02 175/122 |

* cited by examiner

*Primary Examiner* — Nathaniel C Chukwurah

(74) *Attorney, Agent, or Firm* — Tomlinson McKinstry, P.C.

(57) ABSTRACT

A control system for an offboard fluid supply system. The fluid supply system has mud supply pump which may be controlled by a local control system disposed at the fluid supply system. The mud supply pump may also be controlled by a remote control system disposed on a drilling rig. The mud supply pump provides fluid through a conduit to a drill string on the drilling rig. The local control system and the remote control system are paired such that only one of each is connected at one time. While paired, information from both the fluid supply system and drilling rig may be displayed by either control system.

18 Claims, 7 Drawing Sheets

100

DRILLING FLUID SYSTEM

FIELD

The present invention is related to control systems for horizontal directional drills with offboard fluid supply systems.

SUMMARY

The invention is directed to a system. The system comprises a horizontal directional drilling system and a fluid supply system. The horizontal directional drilling system comprises a horizontal directional drilling machine and a drill control system for the horizontal directional drilling machine. The horizontal directional drilling machine has a drill string. The fluid supply system is separated from the horizontal directional drilling machine. The fluid supply system comprises a fluid container, a fluid link between the fluid container and the drill string, a pump interposed in the fluid link, and a fluid supply control system in communication with the drill control system.

The system is characterized by a local mode and a remote mode. In local mode, operation of the fluid supply system is directed solely by the fluid supply control system. In remote mode, operation of the fluid supply system is directed solely by the drill control system. Each of the control systems is configured to switch the system between local and remote mode in response to user input.

In another embodiment the invention is directed to a method. The method comprises drilling an underground bore using a first drill string attached to a first drill rig. The method further comprises providing a fluid link between the first drill string and the fluid supply system. The fluid supply system comprises a container having drilling fluid disposed therein. The method further comprises operating controls at the fluid supply system, thereby directing the fluid supply system to provide drilling fluid through the fluid link to the first drill string. Subsequently, controls are operated at the first drilling rig through a remote control system to provide drilling fluid through the first link to the first drill string.

DETAILED DESCRIPTION

Horizontal directional drilling is a steerable trenchless method of installing underground pipe, conduits, or cables using a surface-launched drilling rig 10. Since horizontal directional drilling is a trenchless method, it results in minimal impact on the surrounding areas and infrastructure.

Horizontal directional drilling is particularly useful when trenching or excavating is not practical, such as when it is necessary to drill under existing structures, highways, or bodies of water. An example of a horizontal directional drilling system is shown in U.S. Pat. No. 4,953,638 issued to Dunn and U.S. Pat. No. RE38,418, issued to Deken, et. al., the contents of which are incorporated herein by reference.

Figure 1:
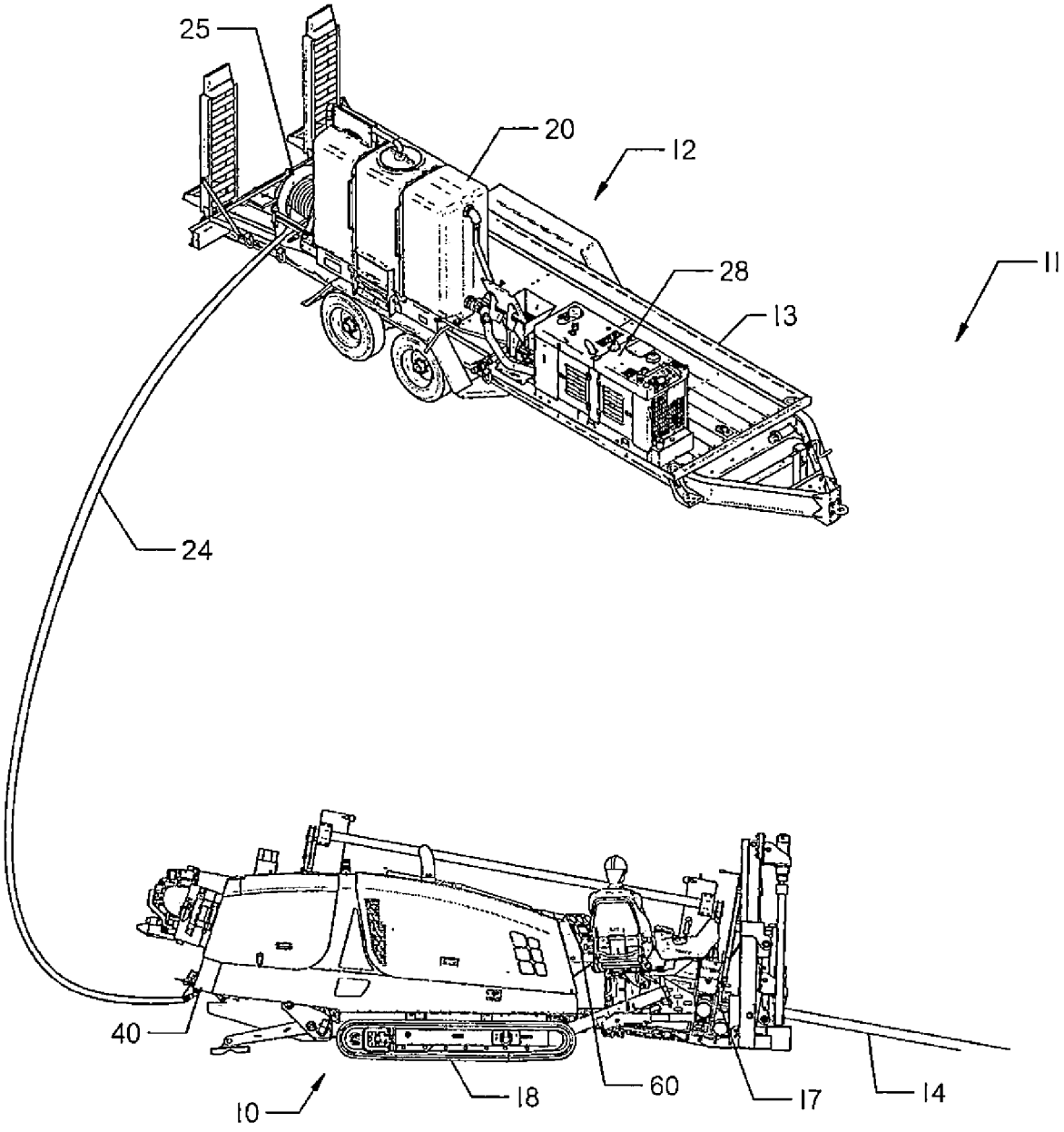
FIG. 1 is a perspective view of a system having a drilling fluid supply system and a drilling rig.
Figure 6:
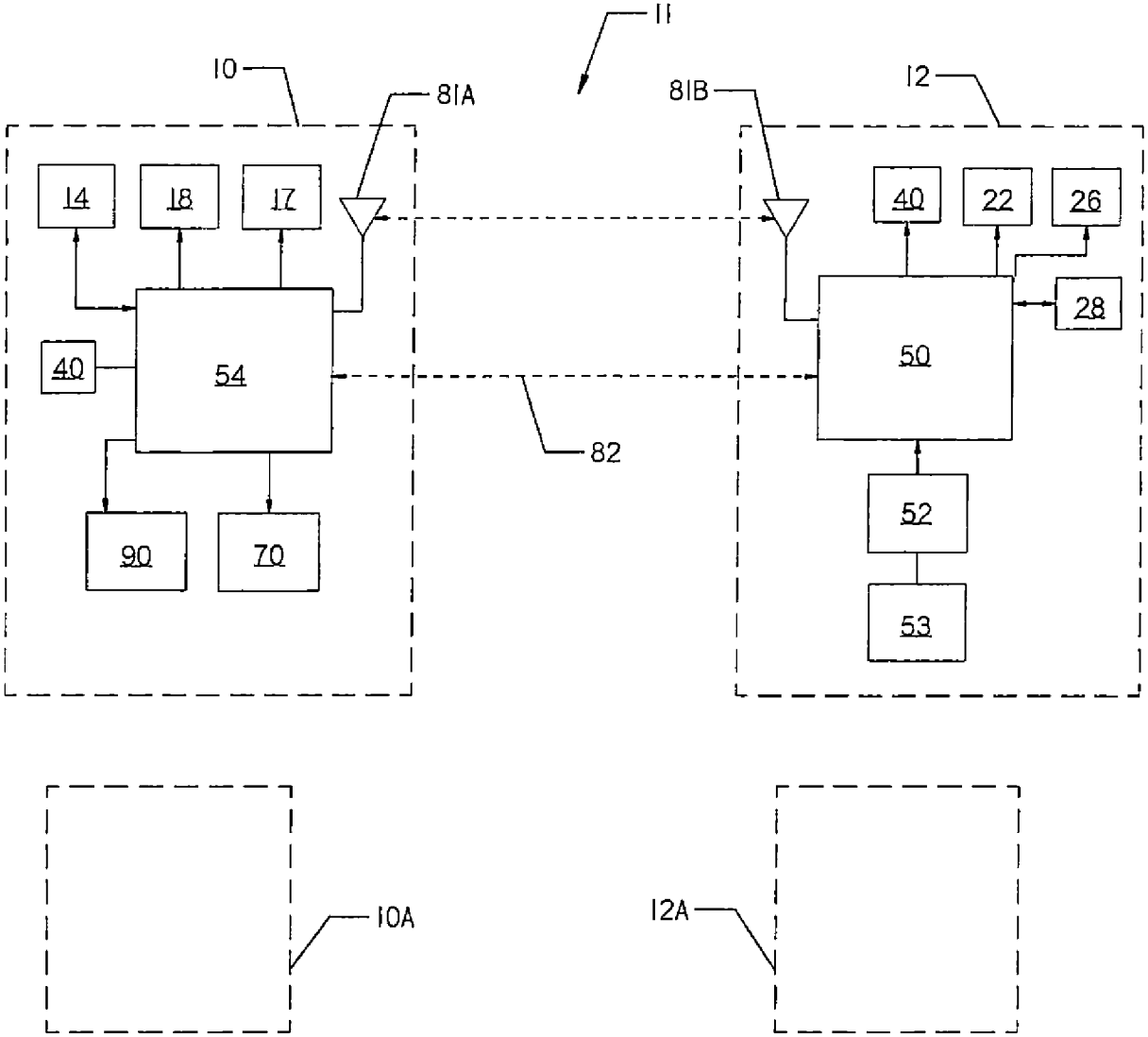
FIG. 6 is a block diagram representing communication between various components of the system of FIG. 1.

With reference to FIG. 1, a directional drilling system 11 includes a drilling rig 10 and a drilling fluid system 12. The drilling rig 10 drills a borehole by steering a drill string 14 through an area underground. The drilling rig 10 comprises conventional elements, such as a carriage and spindle, for driving the drill string 14, and a ground drive 18 for translating the drilling rig. The drilling rig 10 further comprises a wrench 17 for making up and breaking out sections of the drill string 14. As shown in FIG. 6, the drilling rig may have an onboard fluid supply system 70 for providing drilling fluid to the drill string.

Figure 2:
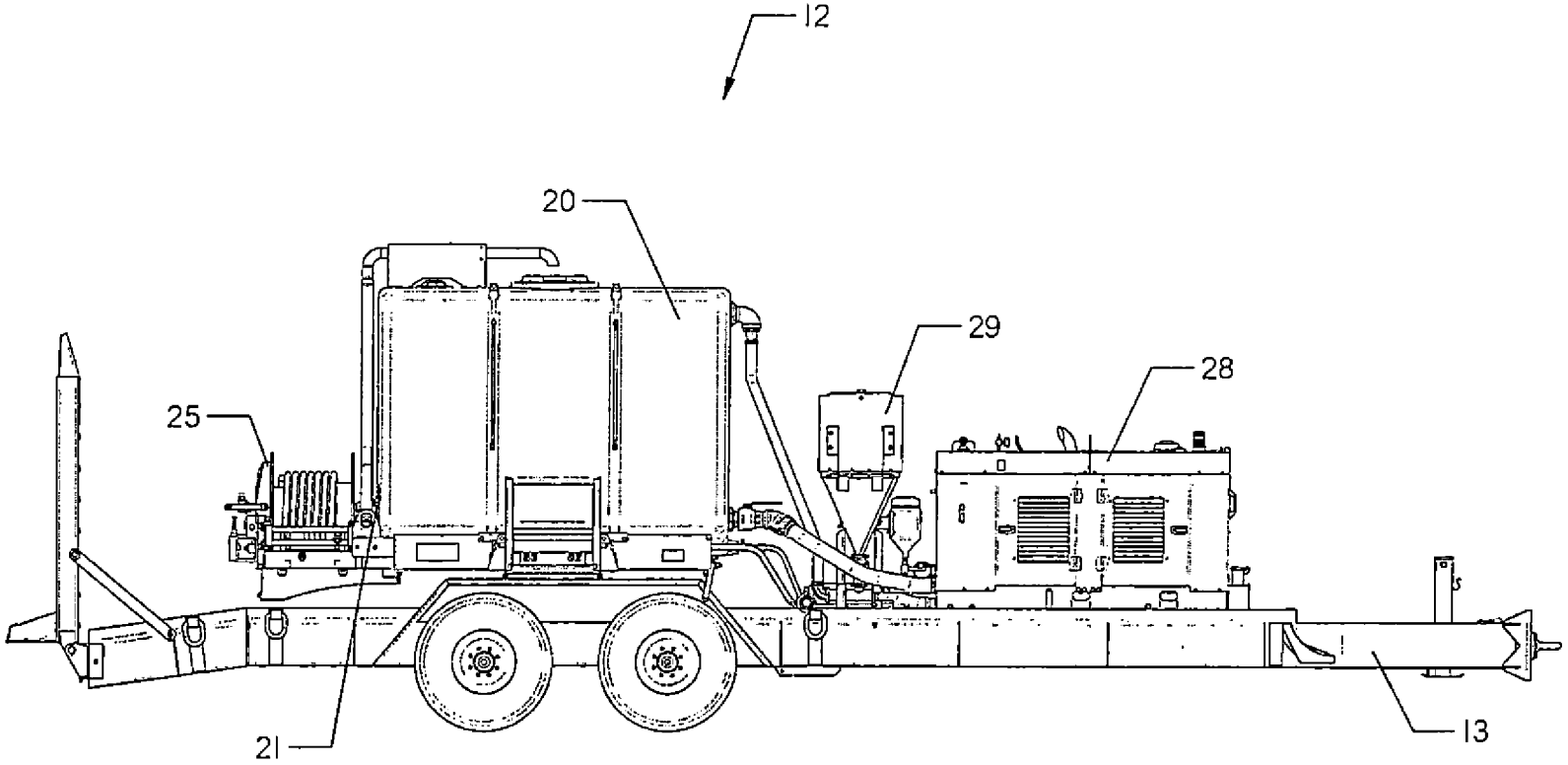
FIG. 2 is a side view of the drilling fluid supply system of FIG. 1.
Figure 3:
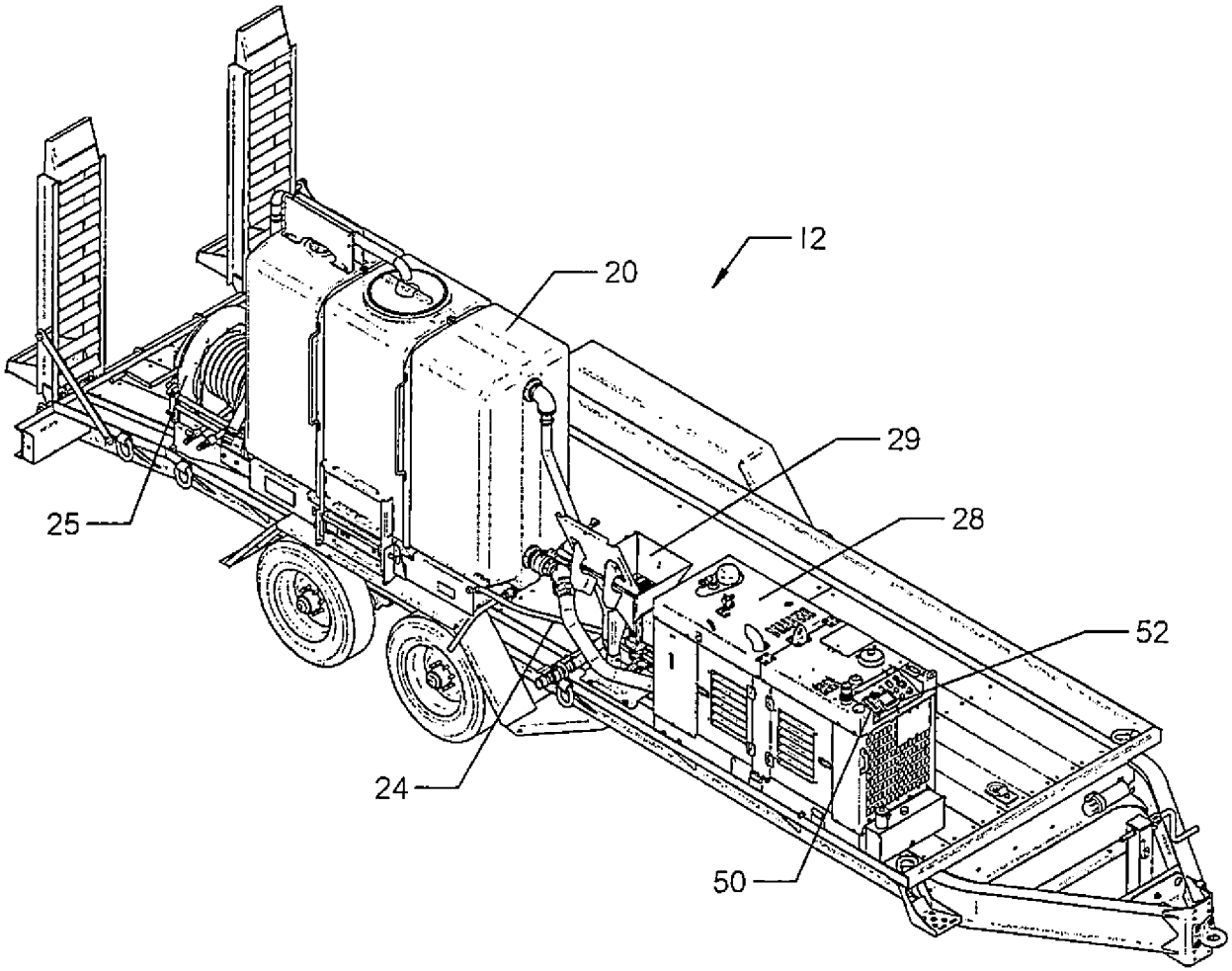
FIG. 3 is a top, front, left side view of the drilling fluid supply system of FIG. 2.
Figure 4:
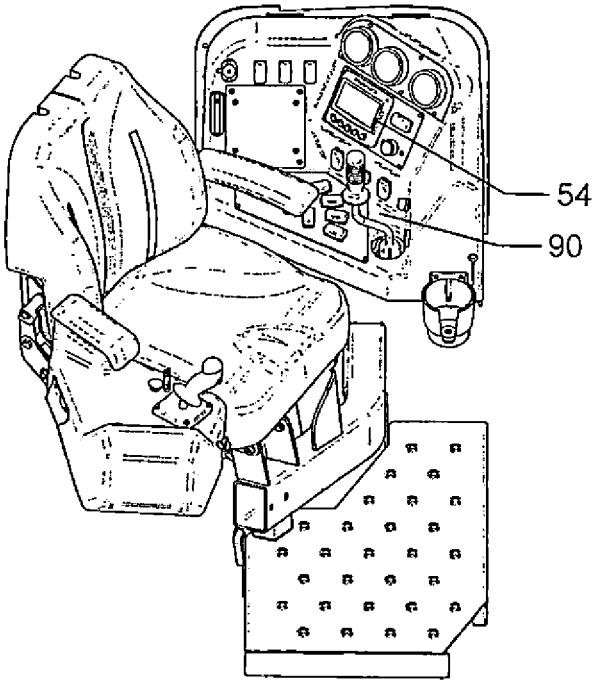
FIG. 4 is a top left perspective view of an operator station.

With reference to FIGS. 1-3, the dedicated drilling fluid system 12 supplies fluid to the drilling rig 10. This drilling fluid system 12 may be provided instead of, or in addition to, the onboard fluid supply system 70. The drilling fluid system 12 circulates fluid through the bore hole created by the drill string 14. Preferably, both of the drilling rig 10 and the drilling fluid system 12 may be transported on a single trailer 13.

Figure 7:
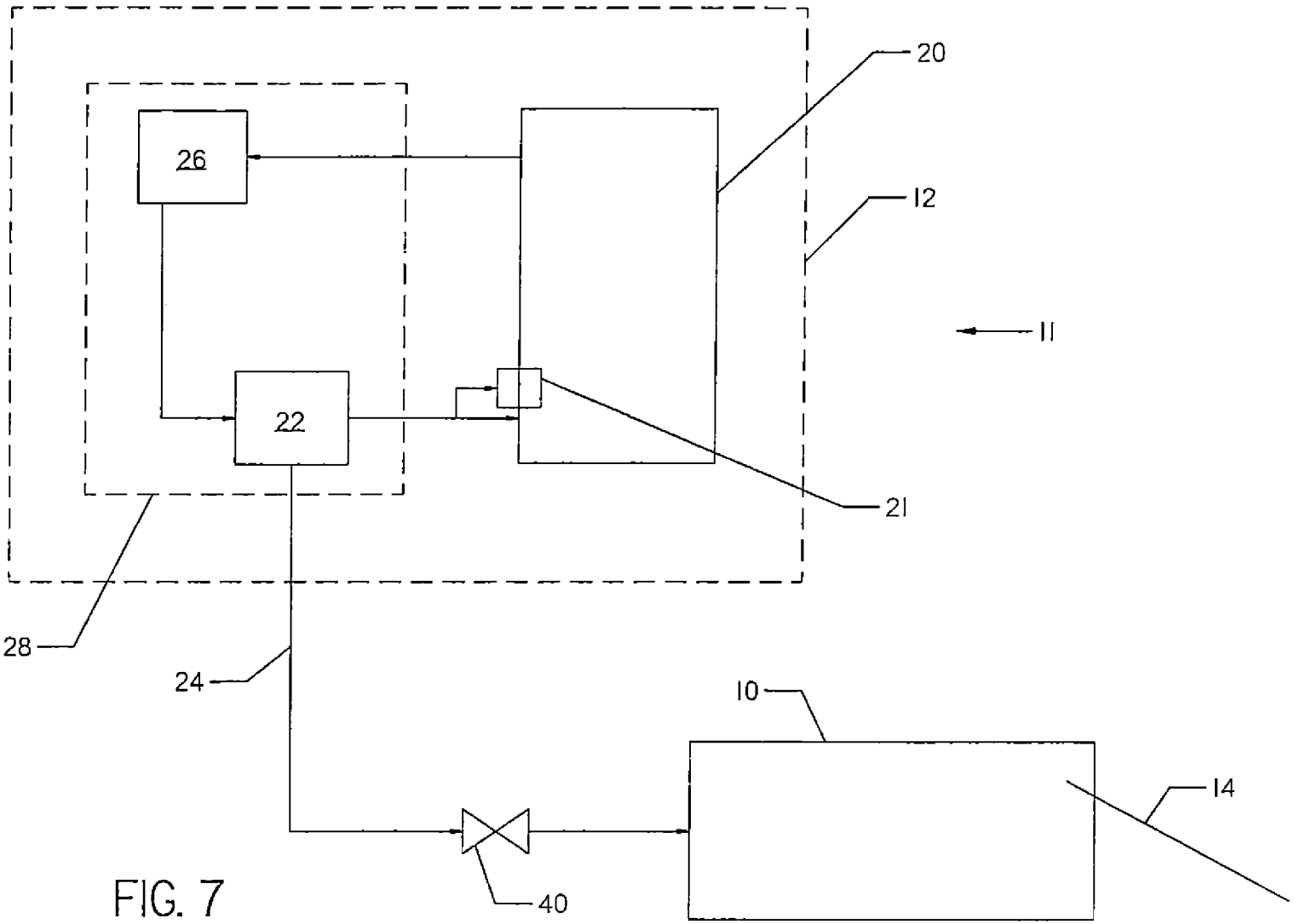
FIG. 7 is a block diagram representing fluid flow through the system of FIG. 1.

The drilling fluid system 12 includes a vessel 20, drilling fluid contained in the vessel, a drilling fluid pump 22, and a fluid link, or conduit 24 extending from the vessel to the drill string. The conduit 24 may be a hose. FIG. 7 is a block diagram indicative of fluid flow through the system it and includes pump 22 which is within a housing 27 and therefore not visible in FIGS. 1-3.

The drilling fluid pump 22 is interposed on the conduit 24 to move drilling fluid from the vessel 20 to the head of the drill string 14. At the head of the drill string 14, the drilling fluid is discharged into the borehole at high pressure. By circulating the drilling fluids through the borehole, fragments of rock and other debris are carried to the surface. Circulation of the drilling fluids also lubricates and cools the drill string 14 and maintains the integrity of the borehole.

The drilling fluid system 12 also comprises a mix pump 26. Mix pump 26 may be enclosed in a housing 27 and therefore may not be visible in FIGS. 1-3, but is represented in FIG. 7. The mix pump 26 encourages an even mixture in drilling fluid. Drilling fluid typically includes a bentonite clay suspended in water. Such fluid should be well-mixed to prevent settlement and provide an even distribution of bentonite substance in the fluid. A hopper 29 is disposed on the trailer 13 proximate the mix pump 26 for addition of solid material to the drilling fluid.

The mix pump 26 may be a centrifugal pump for circulating fluid into and out of the vessel 20 to prevent such a result. Additionally, the vessel 20 may comprise a mixing jet 21 that recirculates some fluid from the mix pump 26 at a high flow rate for agitation purposes.

The drilling fluid pump 22 takes fluid as it passes between the mix pump 26 and the vessel 20 and sends it into the conduit 24. The conduit 24, as shown may be disposed on a reel 25 for stowage and deployment.

The drilling fluid system 12 is powered by a power pack 28. As shown, the power pack 28 and drilling fluid system 12 are on the same trailer 13. The power pack 28 houses components for providing power to various pumps 22, 26, display panels, etc. The power pack 28 comprises a radio for communicating with a similar radio on the drilling rig 10.

The radios use a protocol to pair, such that control systems may be linked and information sent in a two-way manner between the drilling fluid system 12 and the drilling rig 10.

The drilling rig 10 may have its own on-board drilling fluid system (not shown). In such configurations, the drilling fluid system 12 may be used to supplement the on-board system, or vice versa. When the drilling fluid system 12 is operating alone, power components onboard the drilling rig 10 are used for drilling. Such a configuration is beneficial because it increases the maximum power available on the drilling rig 10 for drilling purposes.

In operation, fluid from the vessel 20 is circulated through mix pump 26. When fluid is requested by the drilling rig 10, the drilling fluid pump 22 diverts fluid into the conduit 24. The conduit 24 extends from the drilling fluid system 12 to the drilling rig 10. The drilling rig 10 diverts the drilling fluid into the drill string 14 for use in downhole drilling operations. Flow rates through the drilling fluid pump 22 may be quantified in volume per second, or may be represented as a percentage of mix pump 26 output.

The drilling fluid system 12 also comprises a "quick fill" feature. If quick fill is chosen, the pump 22 operates at its maximum flowrate. Such a quick fill operation may be utilized to quickly fill a new pipe segment that has been added to drill string 14.

A check valve 40 is interposed on the conduit 24 between the pump 22 and the drilling rig 10. The check valve 40 is open while fluid is provided to the drilling rig 10 from the drilling fluid system 12 and may be closed when drilling fluid is not desired, such as when sections of pipe are removed from or added to the drill string 14.

With reference now to FIG. 6, the directional drilling system 11 comprises a controller 50 for directing operations of the drilling fluid system 12 as described above. The controller 50 provides commands to components of the drilling fluid system 12 and records and displays information indicative of the system 12. Because operations of the directional drilling system 11 may be different depending on terrain, obstructions, and the like, it may be beneficial to be able to operate the drilling fluid system 12 either locally, at the system, or remotely from the drilling rig 10.

Figure 5:
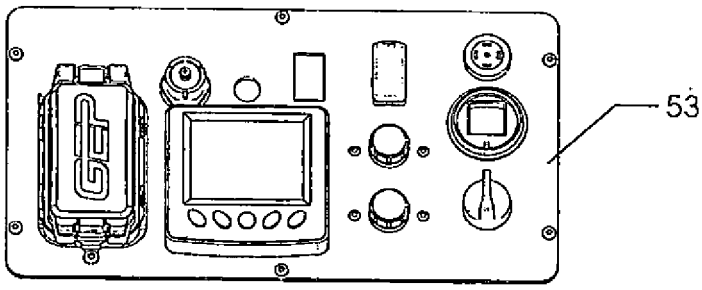
FIG. 5 is a top view of a control panel for a drilling fluid control system.

The controller 50 comprises two controller area network interfaces. These comprise a fluid supply control system 52 disposed at the drilling fluid system 12 and a remote control system 54 at the drilling rig 10. The fluid supply control system 52 controls operation of the pump 22 to direct fluid from the drilling fluid system 12 to the borehole. The fluid supply control system 52 may be accessed at a control panel 53 (FIG. 5). An operator may input whether the controller 50 will be operated in local mode (that is, from the fluid supply control system 52) or remote mode (that is, from the remote control system 54 which may be positioned at drill rig 10).

The remote control system 54 is disposed at an operator station 60 of the drilling rig 10. The drilling rig comprises a control panel 90. The control panel 90 allows operation of various features of the drilling rig 10. Such features may include the carriage and spindle to advance and rotate the drill string 14, the wrench assembly 17, the ground drive 18, etc. These features may also communicate their status to the remote control system 54. The control panel 90 also interfaces with the remote control system 54 to provide input commands to the controller 50.

Preferably, the fluid supply system 12 may be controlled using the same control system 54 as the operator uses to control an on-board fluid pump system, if provided with the drilling rig 10. The control system 54 is configured to utilize an onboard fluid system 70 if drilling fluid is needed by the drilling operation and the controller 50 is not in remote mode. The control system 54 is configured to utilize the fluid supply system 12 when the controller 50 is in remote mode.

The controller 50 therefore supports the option of utilizing drilling equipment without an on-board pump and controlling the drilling fluid system 12 through the remote control system 54, as accessed through the control panel 90. However, the pump 22 of the drilling fluid system 12 may also be controlled manually using the fluid supply control system 52 so that it may be used independently from the drilling rig 10.

The drilling rig 10 has a remote radio 81A. The drilling fluid system 12 comprises a local radio 81B. The connection between the drilling fluid system 12 and the drilling rig 10 is accomplished by radios 81, 81B. An operator stationed at the drilling rig 10 may control the drilling fluid system 12 from the drilling rig 10 without a wired cable to the fluid pump 22. The radios 81A, 81B pair with one another such that the controller 50 may be directly accessed wirelessly using the remote control system 54.

In order for the radios 81A, 81B to communicate, one of the radios transmits a pairing request to the other. The receiving radio saves a unique ID sent in the pairing request and broadcasts a pairing response back to the requesting radio. The receiver has a predetermined time, such as one second, to respond before the pairing request is considered invalid.

The message to the requesting radio contains the receiving radio's unique ID. All messages between radios 81A, 81B contain the sending radio's unique ID in the message header. In this way, only one remote control unit 54 can interface with the controller 50 through radios 81A, 81B at one time. In the same way, a remote control unit 54 knows if it is interfacing with the wrong controller 50. Visual indications of a successful pairing may be displayed at the remote control system 54 and at the fluid supply control system 52. These may include LED indicators on the control panel 90 and/or control panel 53.

In some circumstances, an obstruction or other interference with wireless transmission may occur. When wireless communication between the drilling fluid system 12 and the drilling rig 10 is not effective, it is possible to use a cable backup 82 to interface the drilling rig 10 with the drilling fluid system 12.

As shown in FIG. 6, the system 11 links one drilling rig 10 with one fluid supply system 12. Additional drilling rigs 10A and fluid supply systems 12A may be provided. However, each radio 81A, 81B may only pair with one other radio at one time. Therefore, additional drilling rigs 10A or additional fluid supply systems 12A may not be added while drilling rig 10 is paired to fluid supply system 12. To pair, for example, drilling rig 10A to fluid supply system 12, it must first be paired as discussed above. Once successfully paired, fluid supply system 12 will only communicate with drilling rig 10A, and not drilling rig 10.

Local or remote mode is selectable from the fluid supply control system 52, preferably at a graphical user interface (GUI). The mode selected will be displayed on the GUI during operation. When in remote operation, a strobe may be activated to indicate that the remote connection between remote control system 54 and the controller 50 via radios 81A, 81B is active.

The controller 50 receives an input from a control system 52, 54 according to the mode selected. Input includes fluid pump 22 operation. The fluid pump 22 may be turned on or off, the fluid flow rate set, and a "quick fill" mode utilized by the controller 50.

Parameters may also be set at the control system 52, 54, including maximum and minimum flowrates, pump ramp up and ramp down times for the fluid pump 22 and mix pump 26 and the like. Such parameters define the limits of acceptable operating conditions for the drilling fluid system 12.

The controller 50 processes the input and performs a function. These may include activation or deactivation of the fluid pump, idling of the fluid pump when fluid is not desired for a short period of time, maximum operation of the fluid pump in response to a "quick fill" command, or processing various errors caused by the controller 50 inputs.

Errors may include missing or inconsistent signals. An error condition, such as a missing control system, may indicate that the controller 50 should activate a warning horn or light to notify an operator of the error condition.

Data is received by the controller 50 indicative of the drilling fluid system 12 functions and displayed on a GUI located at either of the control systems 52, 54 based on the mode chosen. These may include information regarding fluid flow rate, fluid pump 22 power, and mix pump 26 power. Information may also include power pack 28 engine oil temperature, power pack 28 engine RPM, status of check valve 40, etc. When remote mode is selected, this is displayed at the remote control system 54. When local mode is selected, this is displayed at the fluid supply control system 52.

The drilling fluid system 12 includes an autothrottle feature. If autothrottle is enabled by the controller 50, the drilling fluid system 12 idles the power pack 28 engine when the controller 50 is not receiving a demand for drilling fluid. Preferably, the power pack 28 engine only idles after a brief delay, to account for interruptions in a signal from the chosen control system 52, 54. More preferably the delay is two seconds.

Additionally, the check valve 40 will be closed by the controller 50 or the remote control system 54 when drilling fluid is turned off and the pump 22 is idled or deactivated, preventing backflow into the drilling fluid system 12. The check valve 40 will be opened by the controller 50 or the remote control system 54 when drilling fluid system 12 and pump 22 are providing fluid through the conduit 24 to the drilling rig 10. The timing of the opening and closing of check valve 40 will be delayed to prevent pressure buildup associated with having a closed valve 40 and an operating fluid pump 22. The delay may be set by either control system 52, 54. The delay may be between 500 and 5000 milliseconds. As shown in FIG. 6, either the controller 50, remote control system 54 at the drilling rig 10, or both may open and close the check valve 40.

The check valve 40 also allows the drilling fluid system 12 to account for interruptions in a signal when the controller is operating in remote mode. When no inputs are received at the controller 50 from the remote control system 54 for a predetermined time, the check valve 40 will close. The predetermined time may be five to ten seconds. Such a period of time will allow a drill operator to continue drilling operations with mud flow during an interruption.

The remote control system 54 may receive a signal indicating the wrench 17 of the drilling rig 10 is closed. In such conditions, mud flow to the drill string 14 is not desired because a connection is being made or broken by the wrench 17. Therefore, a "wrench on" condition detected at the remote control system 54 may be communicated to the controller. The fluid pump 22 may be set to idle and the check valve 40 closed in such conditions.

The fluid pump 22 is configured to idle automatically when a horsepower limit is reached. Reaching a horsepower limit may be indicative of high pressure downstream of the pump 22, causing the power required to continue pumping to spike. Such a condition is indicative of a closed check valve 40. Shutting down the mud pump 22 in this condition prevents damage to the pump and other system components.

Figure 8:
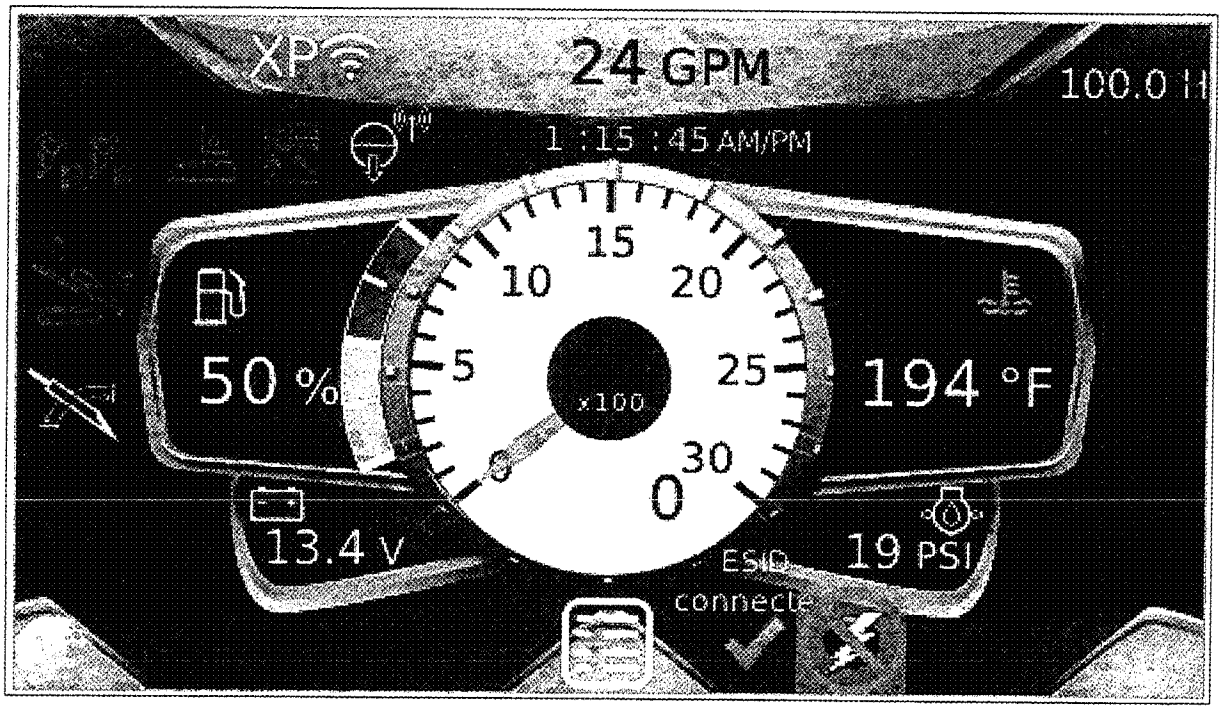
FIG. 8 is a depiction of a graphical user interface for controlling elements of the system.

With reference to FIG. 8, a graphical user interface 100 is shown. This graphical user interface 100 contains information from both the drilling rig 10 and the fluid supply system 12. For example, the RPM, engine temperature and pressure of the drilling rig 10 are shown. Additionally, fluid flow rate from the fluid supply system 12 is shown, along with radio 81A, 81B status, pair status, etc. While the graphical user interface 100 of FIG. 8 may be for the control panel 90 of the drilling rig 10, similar or identical information may be displayed at the fluid supply control system 52.

Modifications can be made in the design and operation of the present invention without departing from the spirit thereof. Thus, while the principle preferred construction and modes of operation of the invention have been explained in what is now considered to represent its best embodiments, which have been illustrated and described, it should be understood that the invention may be practiced otherwise than as specifically illustrated and described.

The invention claimed is:

1. A system, comprising;

a horizontal directional drilling system, comprising:

a horizontal directional drilling machine having a drill string, comprising;

an onboard drill fluid supply system comprising an onboard fluid container and an onboard pump; and a drill control system for the horizontal directional drilling machine; and a fluid supply system separated from the horizontal directional drilling machine, comprising:

a fluid container;

a fluid link between the container and the drill string;

a pump interposed in the fluid link; and a fluid supply control system in communication with the drill control system;

in which the system is characterized by a local mode, in which operation of the fluid supply system is directed solely by the fluid supply control system, and a remote mode, in which operation of the fluid supply system is directed solely by the drill control system, and in which each of the control systems is configured to switch the system between local and remote mode in response to user input; and in which the drill control system is configured to control operation of the onboard drill fluid supply system and in which the system is configured to disable operation of one fluid supply system when the other fluid supply system is operating.

2. The system of claim 1 in which the fluid supply control system is configured to communicate with one and only one drill control system at a time.

3. The system of claim 1 in which the fluid supply control system is configured to establish communication only with the drill control system with which it was last linked, unless countermanded in response to user input.

4. The system of claim r in which each control system is configured to disable operation of the remote fluid system in response to any failure of communication between the remote and local systems.

5. The system of claim 1 further comprising a remote transmitter, in which the remote transmitter is in communication with the fluid supply control system.

6. The system of claim 1 in which the fluid supply system comprises a sensor to sense a first parameter of the fluid supply system.

7. The system of claim 6 in which the first parameter is drilling fluid flow rate through the fluid link.

8. The system of claim 6 wherein the horizontal directional drilling system further comprises a display unit, in which the first parameter of the fluid supply system is displayed on the display unit.

9. The system of claim 1 in which each of the drill control system and the fluid supply control system communicate with a controller.

10. The system of claim 1 in which the horizontal directional drilling system is characterized as a first horizontal directional drilling system, further comprising:

a second horizontal directional drilling system comprising:

a horizontal directional drilling machine having a drill string; and a drill control system for the horizontal directional drilling machine.

11. The system of claim 1 further comprising a check valve interposed in the fluid link, in which the check valve is movable between an open position and a closed position in response to user input.

12. The system of claim 11 in which the check valve is configured to close after a predetermined time when communication between the drill control system and fluid supply control system is disrupted while the system is in remote mode.

13. A method comprising:

drilling an underground bore using a first drill string attached to a first drilling rig;

providing a fluid link between the first drill string and a fluid supply system, wherein the fluid supply system comprises a container having drilling fluid disposed therein;

operating controls at the fluid supply system, thereby directing the fluid supply system to provide drilling fluid through the fluid link to the first drill string;

subsequently, operating controls at the first drilling rig through a remote control system to provide drilling fluid through the fluid link to the first drill string; and with the controls at the first drilling rig, operating the controls to provide drilling fluid to the drill string from a fluid pump disposed onboard the drilling rig.

14. The method of claim 13 further comprising displaying information about the fluid supply system at a display unit disposed on the first drilling rig.

15. The method of claim 13 further comprising directing the fluid supply system to stop providing fluid through the fluid link from controls at the first drilling rig and thereafter idling an engine disposed on the fluid supply system.

16. The method of claim 13 further comprising operating controls at the first drilling rig to grip a section of the first drill string and thereafter automatically closing a check valve disposed on the fluid link.

17. The method of claim 13 further comprising:

discontinuing providing drilling fluid from the fluid supply system to the first drill string;

thereafter, providing a fluid link between the fluid supply system and a second drill string attached to a second drilling rig;

drilling an underground bore using the second drill string; and operating controls at the second drilling rig, through a remote control system to provide drilling fluid through the fluid link to the second drill string.

18. The method of claim 13 in which the controls at the fluid supply system and the controls at the first drilling rig operate a fluid pump, wherein the fluid pump is disposed at the fluid supply system.

* * * * *